United States Patent [19]

Scherer

[11] 4,295,261

[45] Oct. 20, 1981

[54] METHOD OF MOUNTING A THERMAL INSULATING DOOR GASKET

[75] Inventor: Richard M. Scherer, Oxford, Miss.

[73] Assignee: Chambers Corporation, Oxford, Miss.

[21] Appl. No.: 107,090

[22] Filed: Dec. 26, 1979

Related U.S. Application Data

[62] Division of Ser. No. 869,765, Jan. 16, 1978, Pat. No. 4,214,571.

[51] Int. Cl.[3] ..... B23P 11/02

[52] U.S. Cl. ..... 29/451; 29/525; 29/455 R; 29/526 R

[58] Field of Search ..... 29/450, 451, 526 R, 29/525, 455 R; 126/190, 273 R; 277/1

[56] References Cited

U.S. PATENT DOCUMENTS

| | | | |
|---|---|---|---|
| 1,516,130 | 11/1924 | Wirfs | 126/190 X |
| 3,027,444 | 3/1962 | Weeks | 126/273 R |
| 3,033,188 | 5/1962 | Cline et al. | 126/273 R |
| 3,066,212 | 11/1962 | Hurko | 126/273 R |
| 3,121,158 | 2/1964 | Hurko | 126/190 X |
| 3,333,530 | 8/1967 | Reuther | 126/273 X |
| 3,367,316 | 2/1968 | Eff | 126/273 X |

*Primary Examiner*—Charlie T. Moon

*Attorney, Agent, or Firm*—Richards, Harris & Medlock

[57] ABSTRACT

The specification discloses an oven with an outer oven body and an inner oven liner disposed within the body in a spaced apart relationship to provide a space between the body and the liner. Both the body and the liner include open ends facing in the same direction. A removable panel is attached to cover the space between the liner and body. A flexible gasket is clamped between the liner open end and the panel for providing support for the liner and for engaging the oven door to form a seal between the door and the liner.

1 Claim, 4 Drawing Figures

METHOD OF MOUNTING A THERMAL INSULATING DOOR GASKET

This is a division of application Ser. No. 869,765 filed Jan. 16, 1978, now U.S. Pat. No. 4,214,571, issued July 29, 1980.

FIELD OF THE INVENTION

The present invention relates to ovens, and particularly to an oven having a removable panel covering a space between an oven liner and an outer oven body and engaging an improved oven door gasket forming a seal between the door and the oven liner.

BACKGROUND OF THE INVENTION

Modern ovens are generally constructed with an inner oven liner mounted in a spaced apart relationship within an outer oven body to provide a space between the oven body and liner. This space usually contains thermal insulation and often contains oven components such as thermostats, switches, rheostats, electrical wiring and the like. In order to repair and maintain such components, it is sometimes necessary to gain access to this insulated space. The previously developed ovens generally have not been designed to allow easy access to this space. In fact, it often has been necessary heretofore to completely remove the oven liner from the outer oven body to gain access to this space in order to make relatively minor repairs. The inconvenience and expense of such repair procedures have created a need for an oven which allows easy access to the space surrounding the oven liner within the oven body without sacrificing oven appearance, durability or ease of construction.

The extreme heat of ovens, and particularly self-cleaning ovens, requires that the oven liner and the oven door be thermally insulated during the operation of the oven. To provide such thermal insulation, the oven liner generally is mounted within the oven body with insulation between the body and liner, and a thermally insulating gasket is provided to form a seal between the oven liner and the oven door. In many instances, this gasket has been carried by the oven door. U.S. Pat. No. 3,066,212 to Hurko discloses mounting a gasket on the outer face of the oven body. Regardless of the position of prior gaskets, their only function generally has been to provide a thermal seal between the door and the oven liner cavity.

Previously developed ovens have not utilized an insulating gasket as an insulating support for the oven liner, nor has the gasket been used to structuraly support other components of the oven such as a front oven panel. In addition, gaskets used in heretofore developed ovens usually have been installed so as to require difficult disassembly or replacement. Such construction has been found needlessly expensive, and the permanent installation hinders the repair or replacemt of the gasket. Thus, a need has arisen for an oven gasket that provides improved heat sealing while performing multiple functions within the oven to reduce structural duplicity, and to provide ease of installation and removal for repair or for replacement.

SUMMARY OF INVENTION

In accordance with an aspect of the present invention, a box-shaped oven body is provided with a box-shaped liner mounted therein by means of thermally insulating supports. The body and the liner both have open ends facing in the same direction. A space is formed between the liner and the body which is exposed between the peripheries of the liner and body open ends. A panel is removably mounted on the oven body between the peripheries of the two open ends to cover the space between the oven body and liner. The panel has a rectangular outer configuration corresponding to the open end of the oven body and has a rectangular opening corresponding to the open end of the oven liner. By removing the panel, easy access may be gained to the aforementioned space. Electrical components, wiring and insulation are located within this space and a removable panel on the face of the oven facilitates the repair and maintenance of the components located in the space.

In accordance with another aspect of the present invention, the oven liner is provided having an open end and including a front flange extending outwardly from the open end of the liner. An outer flange extends from the outer edge of the front flange generally towards the rear of the oven. A rectangular gasket is provided including a rigid rectangular hoop engaging and circumscribing the outer flange and a rectangular insulating band disposed adjacent to and in front of the front flange. Both the hoop and the band are covered by a single insulating fabric sheath. The walls of the fabric sheath are sewn together along a curved line between the rigid hoop and the insulating band with the sewn line following the curvature of the gasket. The door in a closed position engages the gasket to form a thermal seal between the door and the liner.

In accordance with another aspect of the present invention, the gasket is sized to fit snugly within a rectangular opening in the panel such that the gasket may be placed in the panel opening and frictionally supported therein. In assembly of the oven gasket is positioned in the panel opening, and the panel and gasket are then simultaneously mounted on the oven. In this manner of assembly it is not necessary to hold the gasket in position while the panel is being mounted, and thus assembly is simplified and inexpensive.

In accordance with another aspect of the present invention, the aforementioned panel includes a flange engaging the gasket at a position on the sheath between the rigid hoop and the insulating band. By engaging the gasket, the panel provides support and reinforcement for the liner within the oven body. Additionally, the panel clamps the gasket into proper position adjacent the open end of the liner. In this manner the liner is supported by the panel, but thermally insulated from the panel by the gasket. Since the gasket is held in place by the panel, the gasket may be removed for repair or replacement by removing the panel. Thus, the combination of the removable panel and gasket mounted between the oven body and the liner results in a strong, durable oven that is easy to repair, and yet material and manufacturing expense is kept to a minimum as a result of the mulitple functions of the panel and gasket.

BRIEF DESCRIPTION OF THE DRAWINGS

The advantages and further aspects of the present invention will be readily appreciated by those of ordinary skill in the art as the same becomes better understood by reference to the following detailed description when considered in connection with the accompanying drawings in which.

DESCRIPTION OF PREFERRED EMBODIMENT

Figure 1:
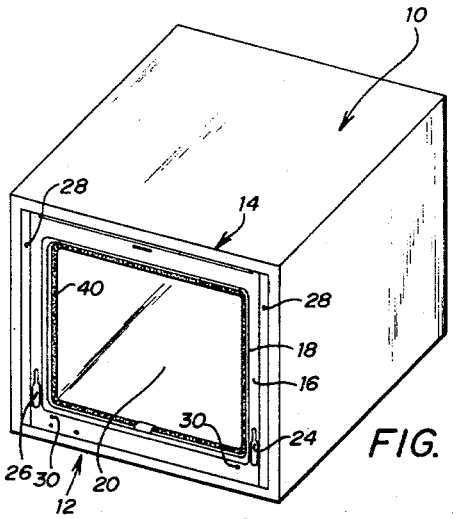
FIG. 1 shows a perspective view of an oven with the door removed for illustration purposes.

Referring to FIG. 1, an oven body 10 is shown embodying the present invention. Oven body 10 is rectangular or box-shaped, with an open end 12 and is shown in FIG. 1 with the oven door removed for clarity of illustration. Mounted on the oven face 14 of oven body 10 is a cover panel 16 which has a substantially rectangular outer configuration and a substantially rectangular interior opening 18. Liner 20 is disposed within body 10 and has an open end aligned with opening 18. Panel 16 includes elongated apertures 24 and 26 which are configured to receive a conventional hinge mechanism for supporting an oven door and includes holes 28 and 30 for receiving screws or bolts for attachment of panel 16.

Oven liner 20 is mounted within oven body 10 in the normal manner in a spaced apart relationship such that a space is formed between liner 20 and oven body 10. Within the space between oven body 10 and liner 20 various oven components may be disposed such as hinge mechanisms, electrical wiring, electrical control and switching devices. Insulation is disposed in the space to prevent heat loss. Liner 20 forms the cooking area of oven body 10, and the open end of liner 20 is aligned with opening 18 in panel 16 to provide an access to liner 20 whereby food may be introduced into liner 20 for cooking.

A gasket 40 is attached to the panel 16 and has a rectangular hoop shape corresponding to the configuration of liner open end 22 and panel interior opening 18. Gasket 40 is disposed between and engages liner 20 and panel 16 and is constructed of a thermal insulating material to provide a thermal insulating support for liner 20 as will be hereinafter described in more detail. Preferably, oven body 10 is made of steel with a porcelain enamel on exposed surfaces; panel 16 is made of brushed chrome plated steel to provide a pleasing appearance; and liner 20 is made of steel with interior surfaces coated with a porcelain enamel.

Figure 2:
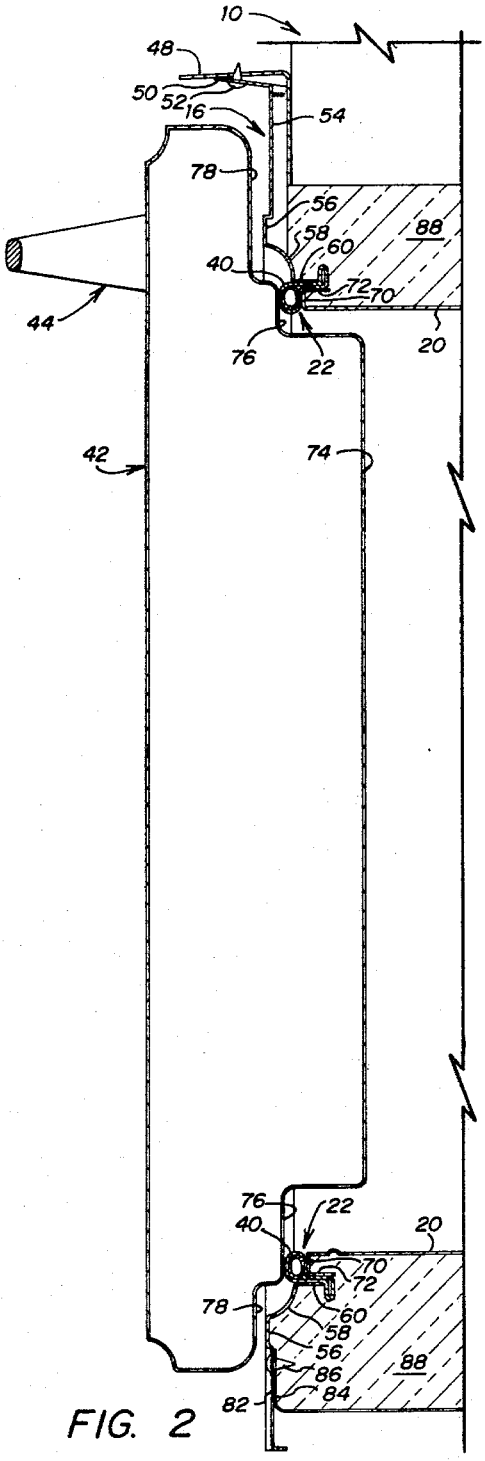
FIG. 2 shows a partial cross section side view of the oven, oven panel, door gasket and an oven door.

Referring now to FIG. 2, a cross-sectional side view of oven body 10 is shown. An oven door 42 including a door handle 44 is shown adjacent to oven body 10. It is to be understood that door 42 is of a conventional construction and may include various interior panels, insulation, and window panes. However, these components have been eliminated in FIG. 2 for clarity of illustration. Along the upper edge of body 10, flange 48 extends from oven body 10 and is disposed to receive panel 16. Inclined flange 50 extends from the top edge of panel 16 and is disposed to engage flange 48 at a small angle of inclination. Flange 50 is attached to flange 48 by sheet metal screws 52 and serves to mount panel 16 on oven body 10.

Planar portion 54 of panel 16 extends inwardly from the top edge of panel 16 towards oven liner 20. Raised portion 56 of panel 16 extends from planar portion 54 and is raised towards door 42. Curved flange 58 extends from raised portion 56 inwardly and rearwardly towards oven liner 20. Extending rearwardly from the end of curved flange 58 is flange 60. Gasket 40 is mounted adjacent to liner 20 engaging flange 60. Liner 20 includes front flange 70 extending outwardly from liner open end 22 and outer flange 72 extending rearwardly from the outer edge of flange 70. Gasket 40 is clamped between outer flange 72 and panel flange 60. Gasket 40 also engages front flange 70.

Door 42 has a stair-stepped interior surface to form, in a closed position, three parallel offset vertical surfaces 74, 76 and 78. In a closed position, surface 74 extends into liner 20 to form the main door surface area. Surface 76 circumscribes surface 74 and is recessed from surface 76 towards the front of the oven to engage gasket 40. Gasket 40 is thus clamped between door surface 76 and front flange 70 when door 42 is in a closed position. Surface 78 of the door circumscribes surface 76 and is recessed further towards the front of the oven. Surface 78 covers in a spaced apart relationship a portion of panel 16 when the door 42 is in a closed position. In this manner a thermal air-tight seal is formed between door 42 and liner 20 by gasket 40 to isolate the cooking area within liner 20 from the surrounding area.

Still referring to FIG. 2, the cross section reveals that the lower edges of door 42 and panel 16 are substantially similar to the corresponding upper edges of door 42 and panel 16. Raised portion 56, curved flange 58, flange 60, gasket 40, front flange 70 and outer flange 72 are formed symmetrically about open end 22 in a manner substantially similar to the cross section of the upper portion of panel 16 shown in FIG. 2. Thus, referring to the lower portion of panel 16, gasket 40 is clamped between outer flange 72 and panel flange 60 and between front flange 70 and vertical door surface 76. Curved flange 58 extends from panel flange 60 and connects to raised portion 56. Extending outwardly from raised portion 56 is planar portion 82. Flange 84 extends from oven body 10 and engages planar portion 82 in a parallel relationship. Flange 84 is removably attached to planar portion 82 by sheet metal screws 86. In this manner, panel 16 is removable secured along its bottom edge to oven body 10.

It is apparent in FIG. 2 that oven liner 20 is disposed within oven body 10 in a spaced apart relationship to provide a space 88 between the liner 20 and body 10. This space 88 contains insulation and may contain various other oven components. Panel 16 covers space 88 on the oven face 14, and thus access may be gained to space 88 by removing panel 16. As repairs become necessary for oven components located in space 88, the ability to remove panel 16 provides a convenient and easy way to effectuate such repairs. In this manner the expense of such repairs and the time required to make the repairs are minimized.

Figure 3:
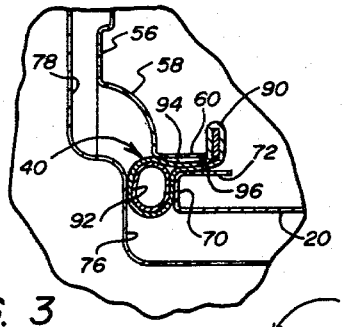
FIG. 3 shows an enlarged cross section detail of a oven gasket mounted in position on an oven.

Reference is now made to FIG. 3 for a more detailed description of gasket 40. Gasket 40 consists essentially of three elements, a substantially rectangular rigid hoop 90, insulating band 92 and a fabric sheath 94. Rigid hoop 90 circumscribes outer flange 72 and is disposed immediately to the rear of panel flange 60. Rigid hoop 90 is preferably constructed of steel but may be constructed of any rigid, non-flammable material with a high melting point. Insulating band 92 is disposed adjacent to and in front flange 70 an is clamped between flange 70 and door surface 76 when door 42 is in a closed position. Preferably, band 92 is a woven stainless steel tube having a sponge-like resiliency, but band 92 may be constructed of any non-flammable insulating material having a high melting point.

A single fabric sheath 94 encompasses hoop 90 and band 92 and supports band 92 in position adjacent front flange 70. Sheath 94 is tubular in construction and is preferably made of a woven fiberglass material. However, any non-flammable insulating fabric having a high melting point would be suitable for use in the manufacture of sheath 94. Sheath 94 is sewn together by a fiberglass thread 96 along a line between hoop 90 and band 92. By sewing sheath 94 together, hoop 90 and band 92 are separated from one another, and sheath 94 is prevented from rotating or twisting about hoop 90 or band 92. The cross-sectional circumference of sheath 94 is chosen to permit gasket 40 to fit snugly in its mounted position. Thus, the cross-sectional circumference of sheath 94 should be great enough to allow the sheath to encompass band 92, to extend rearwardly between flanges 72 and 60, and to encompass hoop 90. However, the cross-sectional circumference of sheath 94 must be small enough such that hoop 90 firmly presses against the rearward edge of flange 60 and band 92 is supported snugly adjacent flange 70.

Referring again to FIG. 3, it may be seen that panel 16, gasket 40 and oven liner 20 interact to mutually support and secure one another. Rigid hoop 90 engages panel flange 60 through sheath 94 and tends to prevent panel 16 from shifting towards the rear of the oven. Flange 60 also prevents gasket 40 from moving forward towards the front of the oven along outer flange 72. Insulating band 92 is chosen to be too large to pass between panel flange 60 and outer flange 72 and engages flange 70 through sheath 94 and to prevent gasket 40 from moving towards the rear of the oven. Flange 60 extending from panel 16 engages outer flange 72 of liner 20 through sheath 94 and each will tend to support and stabilize the other. In this manner panel 16 by engaging liner 20 through gasket 40 performs a dual function. First, panel 16 serves as an insulated support for liner 20, and second, panel 16 clamps and secures gasket 40 in its proper position on liner flanges 70 and 72.

Figure 4:
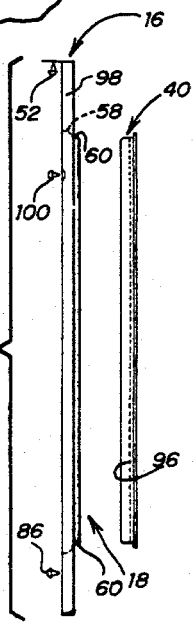
FIG. 4 shows a side view of a front oven cover panel and a door sealing gasket aligned to be mounted on the panel.

Referring now to FIG. 4, a side view of panel 16 is shown removed from oven body 10. Two flanges 98, of which one is shown, extend from the vertical sides of panel 16 in a direction, as mounted, towards the oven body 10. Oven body 10 is adapted to receive flanges 98 such that the outer surfaces of these flanges are adjacent body 10 and form a smooth junction betwen panel 16 and body 10. In this view screws 52, 86, and 100 are shown in their respective positions for supporting panel 16 on oven body 10. Although sheet metal screws are used in the preferred embodiment to removably secure panel 16 on body 10, it is to be understood that many suitable methods are available for removably attaching panel 16 to body 10 such as by bolts, clamps, friction locks, magnets, etc.

In FIG. 4, gasket 40 is shown in an exploded view aligned to be mounted on panel 16. This view illustrates how thread 96 sews sheath 94 together along a line between band 92 and hoop 90. Gasket 40 is mounted on panel 16 by aligning and forcing gasket 40 into opening 18 of panel 16 to frictionally engage panel flange 60. Gasket 40 has a sufficiently large perimeter to frictionally engage panel flange 60 such that gasket 40 is frictionally supported on panel 16. This feature facilitates the mounting of panel 16 and gasket 40 on oven body 10 by eliminating the necessity of separately holding gasket 40 in position while panel 16 is being mounted. Instead, gasket 40 is first mounted on panel 16 within panel interior opening 18, and then panel 16 and gasket 40 are simultaneously mounted on oven body 10 with panel flange 60 of panel 16 pressing gasket 40 against outer flange 72 of liner 20 to secure gasket 40 in proper position adjacent liner open end 22. This manner of assembly may be performed quickly and easily by one worker, thereby resulting in an inexpensive method of assembly.

Although particular embodiments of the present invention have been described in the foregoing detailed description, it will be understood that the invention is not limited to the embodiments disclosed, but is capable of numerous rearrangements, modifications, and substitution of parts and elements without departing from the spirit of the invention.

What is claimed is:

1. A method of mounting a thermal insulating door gasket adjacent an oven liner comprising:

aligning the gasket with a panel opening in an oven panel having an opening perimeter slightly smaller than a perimeter of the gasket;

forcing the gasket into the panel opening to frictionally mount the gasket on the oven panel;

aligning the panel opening with an open end of an oven liner mounted within an oven body;

forcing the panel opening over the liner open end pressing the oven gasket between the liner and the oven panel and exposing a portion of the gasket for engaging an oven door; and securing the oven panel to the oven body to secure the gasket on the open end of the liner.

* * * * *